US010272305B2

(12) United States Patent
Ban

(10) Patent No.: US 10,272,305 B2
(45) Date of Patent: Apr. 30, 2019

(54) GOLF CLUB SET

(71) Applicant: BRIDGESTONE SPORTS CO., LTD., Tokyo (JP)

(72) Inventor: Wataru Ban, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 17 days.

(21) Appl. No.: 15/801,862

(22) Filed: Nov. 2, 2017

(65) Prior Publication Data

US 2018/0154230 A1 Jun. 7, 2018

(30) Foreign Application Priority Data

Dec. 2, 2016 (JP) ..... 2016-235252

(51) Int. Cl.
*A63B 53/00* (2015.01)
*A63B 60/00* (2015.01)
*A63B 53/04* (2015.01)

(52) U.S. Cl.
CPC ..... *A63B 60/00* (2015.10); *A63B 53/047* (2013.01); *A63B 53/0466* (2013.01); *A63B 2053/005* (2013.01); *A63B 2053/0479* (2013.01); *A63B 2060/002* (2015.10)

(58) Field of Classification Search
USPC ..... 473/287–291
See application file for complete search history.

(56) References Cited

U.S. PATENT DOCUMENTS 3,395,571 A * 8/1968 Murdoch ..... A63B 53/00 73/579
3,963,236 A * 6/1976 Mann ..... A63B 53/00 473/289
3,984,103 A * 10/1976 Nix ..... A63B 53/00 473/291
4,070,022 A * 1/1978 Braly ..... A63B 53/00 473/289
4,261,566 A * 4/1981 MacDougall ..... A63B 60/42 473/289
4,679,791 A * 7/1987 Hull ..... A63B 53/00 473/201
4,900,025 A * 2/1990 Suganuma ..... A63B 53/00 473/289

(Continued)

FOREIGN PATENT DOCUMENTS

JP 54-094463 U 7/1979
JP 62-038187 A 2/1987

(Continued)

*Primary Examiner* — Alvin A Hunter
(74) *Attorney, Agent, or Firm* — Sughrue Mion, PLLC

(57) ABSTRACT

A golf club set includes a plurality of golf clubs having different loft angles. The plurality of golf clubs have the same lie angle. Each loft angle difference between two golf clubs that are adjacent in a loft angle order is the same. Each club length difference between two golf clubs that are adjacent in the loft angle order is 0.125 inches (3.175 mm) (inclusive) to 0.375 inches (9.525 mm) (inclusive). A loft angle of a golf club having a minimum frequency is smaller than a loft angle of a golf club having a maximum frequency. A difference between the minimum frequency and the maximum frequency is not less than 40 cpm.

14 Claims, 5 Drawing Sheets

(56) References Cited

U.S. PATENT DOCUMENTS

| | | | | | |
|---|---|---|---|---|---|
| 4,971,321 | A | * | 11/1990 | Davis | A63B 53/00 473/287 |
| 5,228,688 | A | * | 7/1993 | Davis | A63B 53/00 473/290 |
| 5,595,547 | A | * | 1/1997 | Lekavich | A63B 53/00 473/287 |
| 5,823,887 | A | * | 10/1998 | Mikame | A63B 53/04 473/290 |
| 6,379,260 | B1 | * | 4/2002 | Iwade | A63B 53/04 473/290 |
| 6,916,251 | B2 | * | 7/2005 | Shiraishi | A63B 53/00 473/289 |

FOREIGN PATENT DOCUMENTS

| | | | | |
|---|---|---|---|---|
| JP | 1-155468 | U | | 10/1989 |
| JP | 4-187164 | A | | 7/1992 |
| JP | 5-277211 | A | | 10/1993 |
| JP | 2000-317017 | A | | 11/2000 |
| JP | 2002177415 | A | * | 6/2002 |
| JP | 2003144587 | A | * | 5/2003 |
| JP | 2003144588 | A | * | 5/2003 |
| JP | 2004216108 | A | * | 8/2004 |
| JP | 2007-167179 | A | | 7/2007 |
| JP | 2007167179 | A | * | 7/2007 |
| JP | 2016-059568 | A | | 4/2016 |

* cited by examiner

FIG. 4A

| CLUB | θ1 | θ2 | Ws | Fs | L1 | Wc | L2 | FQ | BL |
|---|---|---|---|---|---|---|---|---|---|
| #5 | 61.5 | 24 | 94 | R | 37.75 | 405 | 741 | 313 | D1.5 |
| #6 | 61.5 | 28 | 94 | R | 37.50 | 407 | 739 | 316 | D1.5 |
| #7 | 61.5 | 32 | 97 | S | 37.25 | 414 | 733 | 334 | D1.5 |
| #8 | 61.5 | 36 | 97 | S | 37.00 | 418 | 730 | 337 | D1.5 |
| #9 | 61.5 | 40 | 103 | X | 36.75 | 428 | 722 | 359 | D1.5 |
| PW | 61.5 | 44 | 103 | X | 36.50 | 431 | 719 | 361 | D1.5 |

FIG. 4B

| CLUB | θ1 | θ2 | Ws | Fs | L1 | Wc | L2 | FQ | BL |
|---|---|---|---|---|---|---|---|---|---|
| #5 | 61 | 24 | 97 | S | 38.00 | 403 | 742 | 322 | D1 |
| #6 | 61.5 | 27 | 97 | S | 37.50 | 410 | 736 | 329 | D1 |
| #7 | 62 | 31 | 97 | S | 37.00 | 417 | 729 | 337 | D1 |
| #8 | 62.5 | 35 | 97 | S | 36.50 | 425 | 722 | 345 | D1 |
| #9 | 63 | 39 | 97 | S | 36.00 | 432 | 716 | 352 | D1 |
| PW | 63.5 | 44 | 97 | S | 35.50 | 439 | 711 | 357 | D1 |

FIG. 4C

| CLUB | θ1 | θ2 | Ws | Fs | L1 | Wc | L2 | FQ | BL |
|---|---|---|---|---|---|---|---|---|---|
| #5 | 61.5 | 24 | 97 | S | 37.25 | 414 | 734 | 334 | D1.5 |
| #6 | 61.5 | 28 | 97 | S | 37.25 | 414 | 733 | 335 | D1.5 |
| #7 | 61.5 | 32 | 97 | S | 37.25 | 414 | 732 | 335 | D1.5 |
| #8 | 61.5 | 36 | 97 | S | 37.25 | 414 | 732 | 335 | D1.5 |
| #9 | 61.5 | 40 | 97 | S | 37.25 | 414 | 732 | 335 | D1.5 |
| PW | 61.5 | 44 | 97 | S | 37.25 | 415 | 732 | 335 | D1.5 |

FIG. 4D

| CLUB | θ1 | θ2 | Ws | Fs | L1 | Wc | L2 | FQ | BL |
|---|---|---|---|---|---|---|---|---|---|
| #5 | 61.5 | 24 | 94 | R | 37.25 | 411 | 736 | 320 | D1.5 |
| #6 | 61.5 | 28 | 94 | R | 37.25 | 411 | 735 | 320 | D1.5 |
| #7 | 61.5 | 32 | 97 | S | 37.25 | 414 | 732 | 335 | D1.5 |
| #8 | 61.5 | 36 | 97 | S | 37.25 | 414 | 732 | 335 | D1.5 |
| #9 | 61.5 | 40 | 103 | X | 37.25 | 420 | 727 | 351 | D1.5 |
| PW | 61.5 | 44 | 103 | X | 37.25 | 420 | 728 | 351 | D1.5 |

FIG. 4E

| CLUB | θ1 | θ2 | Ws | Fs | L1 | Wc | L2 | FQ | BL |
|---|---|---|---|---|---|---|---|---|---|
| #5 | 61.5 | 24 | 97 | S | 37.75 | 415 | 742 | 324 | D1.5 |
| #6 | 61.5 | 28 | 97 | S | 37.50 | 414 | 738 | 329 | D1.5 |
| #7 | 61.5 | 32 | 97 | S | 37.25 | 414 | 733 | 334 | D1.5 |
| #8 | 61.5 | 36 | 97 | S | 37.00 | 413 | 728 | 339 | D1.5 |
| #9 | 61.5 | 40 | 97 | S | 36.75 | 415 | 722 | 348 | D1.5 |
| PW | 61.5 | 44 | 97 | S | 36.50 | 415 | 717 | 352 | D1.5 |

FIG. 5

| | MINIMUM VALUE | MAXIMUM VALUE | DIFFERENCE |
|---|---|---|---|
| EXAMPLE1 | 313 | 361 | 48 |
| COMPARATIVE EXAMPLE1 | 322 | 357 | 35 |
| COMPARATIVE EXAMPLE2 | 334 | 335 | 1 |
| COMPARATIVE EXAMPLE3 | 320 | 351 | 31 |
| COMPARATIVE EXAMPLE4 | 324 | 352 | 28 |

GOLF CLUB SET

BACKGROUND OF THE INVENTION

Field of the Invention

The present invention relates to a golf club set.

Description of the Related Art

In a golf club set, the club length generally changes depending on a club. A golfer needs to match a swing with the length of a golf club to use. There are proposed golf club sets in which some or all of golf clubs in a golf club set have close club lengths (Japanese Patent Laid-Open Nos. 2016-059568, 2000-317017, and 62-038187, Japanese Utility Model Laid-Open Nos. 01-155468 and 54-094463, and Japanese Patent Laid-Open Nos. 04-187164, 05-277211, and 2007-167179).

In a golf club set in which the club lengths are close, the posture difference at address becomes small between golf clubs to use, and this may contribute to stabilization of swing. However, if the club lengths are simply made close, a golfer who is familiar with a general golf club set with different club lengths sometimes feels difficulty in swing. For example, with a middle or long iron, the golfer may be unable to sense deflection of the shaft, and the ball flight may become low. Conversely, with a short iron or wedge, the shaft may deflect too much, and the ball flight may become unstable.

SUMMARY OF THE INVENTION

It is an object of the present invention to provide a golf club set that reduces difficulty in swing while setting club lengths to close lengths.

According to an aspect of the present invention, there is provided a golf club set comprising a plurality of golf clubs having different loft angles, wherein the plurality of golf clubs have the same lie angle, each loft angle difference between two golf clubs that are adjacent in a loft angle order is the same, each club length difference between two golf clubs that are adjacent in the loft angle order is 0.125 inches (3.175 mm) (inclusive) to 0.375 inches (9.525 mm) (inclusive), a loft angle of a golf club having a minimum frequency is smaller than a loft angle of a golf club having a maximum frequency, and a difference between the minimum frequency and the maximum frequency is not less than 40 cpm.

According to another aspect of the present invention, there is provided a golf club set comprising a plurality of golf clubs having different loft angles, wherein the plurality of golf clubs have the same lie angle, each loft angle difference between two golf clubs that are adjacent in a loft angle order is the same, each club length difference between two golf clubs that are adjacent in the loft angle order is 0.125 inches (3.175 mm) (inclusive) to 0.375 inches (9.525 mm) (inclusive), a loft angle of a golf club having a minimum frequency is smaller than a loft angle of a golf club having a maximum frequency, the minimum frequency is less than 320 cpm, and the maximum frequency exceeds 360 cpm.

Further features of the present invention will become apparent from the following description of exemplary embodiments (with reference to the attached drawings).

BRIEF DESCRIPTION OF THE DRAWINGS

FIG. 4A is a view showing the specifications of the golf club set according to an example;

FIGS. 4B to 4E are views showing the specifications of golf club sets according to comparative examples; and FIG. 5 is a view showing the difference between the minimum frequency and the maximum frequency in each of the golf club sets according to the example and the comparative examples.

DESCRIPTION OF THE EMBODIMENTS

Figure 1:
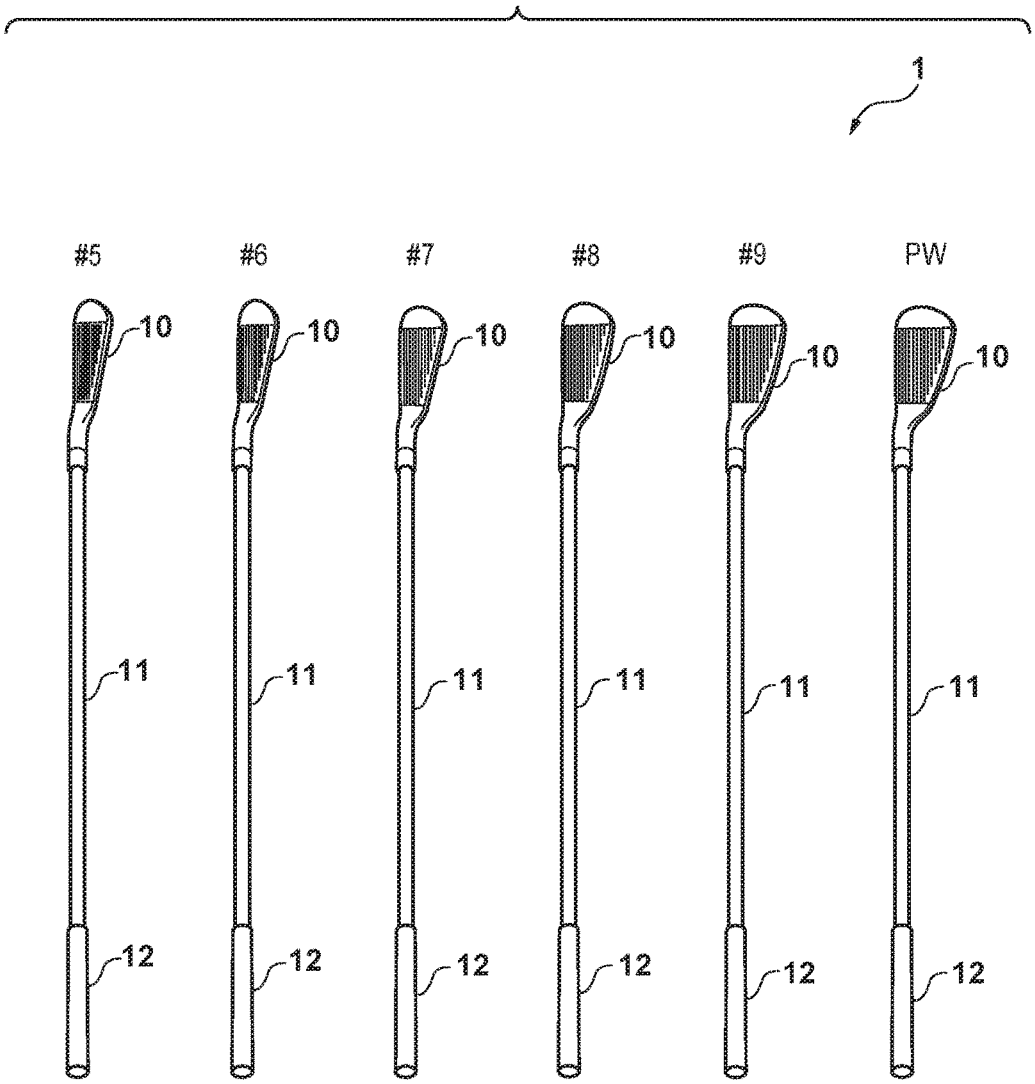
FIG. 1 is a view showing the outer appearance of a golf club set according to an embodiment of the present invention.

FIG. 1 is a view showing the outer appearance of a golf club set 1 according to an embodiment of the present invention. The golf club set 1 according to this embodiment is an iron type golf club set and is formed by six golf clubs including a 5-iron (#5) to a pitching wedge (PW). However, the set composition is not limited to this, and may be formed by seven or more golf clubs or five or less golf clubs. The golf club set may be a wood type golf club set or a utility type (hybrid type) golf club set, or a golf club set including both iron type and wood type golf clubs.

Figure 2A:
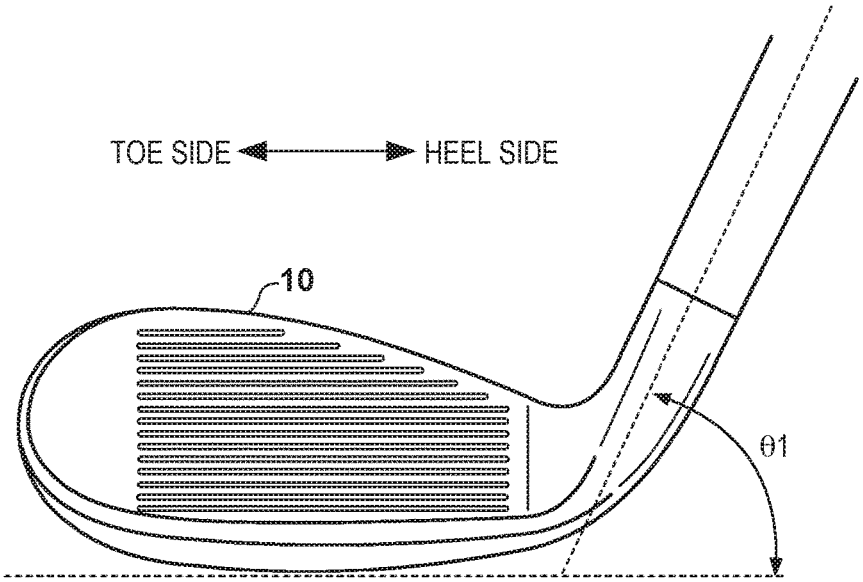
FIG. 2A is an explanatory view of a lie angle.
Figure 2B:
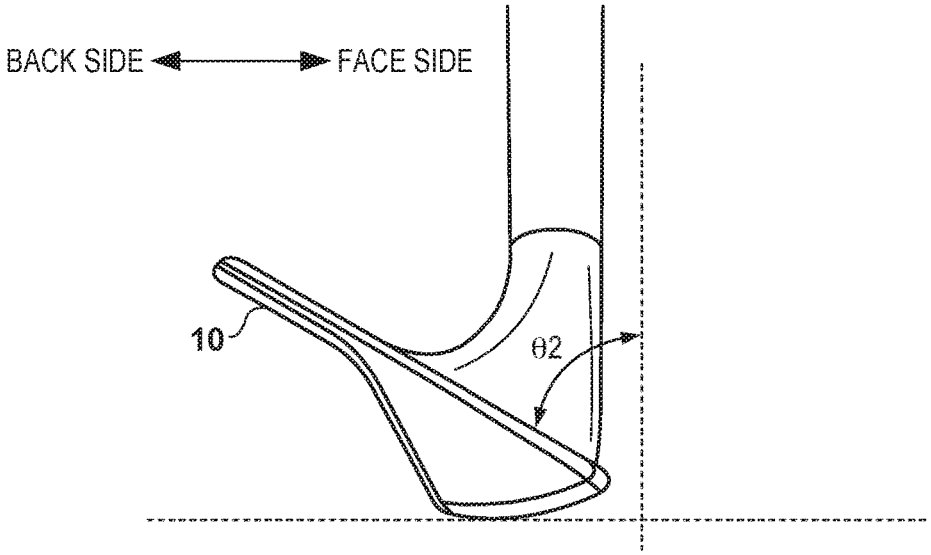
FIG. 2B is an explanatory view of a loft angle.

Each golf club includes a head 10, a shaft 11, and a grip 12. The head 10 is attached to one end of the shaft 11, and the grip 12 is attached to the other end of the shaft 11. The six golf clubs according to this embodiment have the same lie angle. However, the loft angle is designed to become large sequentially from the 5-iron to the pitching wedge. The definitions of the lie angle and the loft angle comply with the rules of golf club. FIGS. 2A and 2B are explanatory views of the lie angle and the loft angle in an iron type golf club.

The lie angle is an angle (θ1) made by a ground surface and a shaft axis when the head 10 is grounded at a face angle of 0° such that the score lines of a face (striking face) become parallel to the ground surface. The loft angle is an angle (θ2) made by a surface perpendicular to the ground surface and a plane in contact with the center of the face when the head 10 is grounded at a face angle of 0° such that the score lines of the face (striking face) become parallel to the ground surface. The center of the face is the center of the longest score line in the toe-heel direction.

In the six golf clubs according to this embodiment, each loft angle difference between two golf clubs that are adjacent in the order of the magnitude of the loft angle θ2 (loft angle order) is the same. Accordingly, the differences in the distance of a shot between the clubs can be set to close distance differences. In this embodiment, the combinations of two golf clubs that are adjacent in the order of the magnitude of the loft angle θ2 are a total of five sets including the set of the 5-iron and the 6-iron, the set of the 6-iron and the 7-iron, . . . , the set of the 9-iron and the pitching wedge. The loft angle difference can be selected from angles within the range of, for example, 2° to 6°. Note that "the same lie angle" or "the same loft angle difference" means that the values are equal from the viewpoint of design, and a difference caused by a manufacturing error is neglected.

Figure 3A:
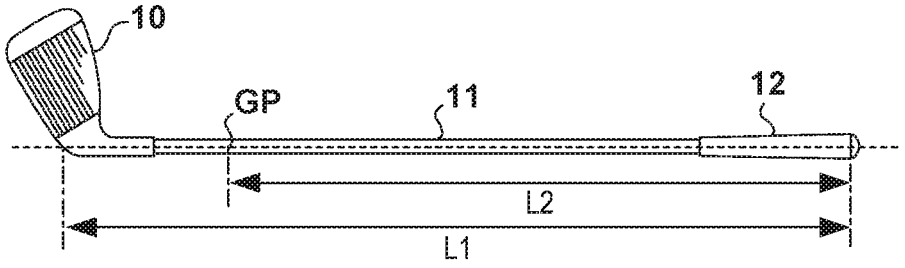
FIG. 3A is an explanatory view of a club length and a center-of-gravity position.

As for the six golf clubs according to this embodiment, the club lengths are designed to close lengths. More specifically, each club length difference between two golf clubs that are adjacent in the order of the magnitude of the loft angle θ2 is 0.125 inches (3.175 mm) to 0.375 inches (9.525 mm), preferably, 0.25 inches (6.35 mm)±0.079 inches (±2 mm), and more preferably, 0.25 inches (6.35 mm). For example, the difference between the club length of the 5-iron and that of the 6-iron is designed to these numerical values. This also applies to the remaining four combinations. When the club lengths are designed to close lengths, the posture of a golfer at address changes little depending on the golf club to use, and this may contribute to stabilization of swing. FIG. 3A is an explanatory view of the club length of an iron type golf club.

The club length is a distance (L1) from the intersection between the shaft axis and the sole portion of the head 10 to the cap line of the grip 12. FIG. 3A also shows a center-of-gravity distance L2. The center-of-gravity distance L2 is the distance from a center-of-gravity position GP of the golf club to the cap line of the grip 12.

If the club lengths of the golf clubs of the golf club set are only made close, a golfer who is familiar with a general golf club set with different club lengths sometimes feels difficulty in swing. For example, with the 5-iron, the golfer may be unable to sense deflection of the shaft, and the ball flight may become low. Conversely, with the pitching wedge, the shaft may deflect too much, and the ball flight may become unstable. Hence, the frequency of each club is adjusted based on the flex of the shaft 11 or the weight of the shaft 11 or the head 10, thereby reducing the difficulty in swing.

The frequency of each club is changed in accordance with the loft angle θ2. For example, each golf club is designed such that the frequency increases along with an increase in the loft angle θ2. In the 5-iron or the like, this allows the golfer to easily sense the deflection of the shaft, and a shot easily rises. On the other hand, in the pitching wedge or the like, the deflection of the shaft is suppressed, and the ball flight easily stabilizes.

The frequencies of the clubs from the 5-iron to the pitching wedge are expressed as FQ(#5), FQ(#6), . . . , FQ(FW). The magnitude relationship is preferably, for example, FQ(#5)<FQ(#6)< . . . <FQ(PW) such that the frequency sequentially increases along with an increase in the loft angle θ2. Alternatively, for example, the frequencies may be approximate (or equal) between some adjacent clubs, and for example, FQ(#5)≈FQ(#6)<FQ(#7)≈FQ(#8)<FQ(#9)≈FQ(PW) may hold. Based on the same concept, FQ(#5)<FQ(#6)≈FQ(#7)<FQ(#8)≈FQ(#9)<FQ(PW) may hold. Alternatively, FQ(#5)≈FQ(#6)≈FQ(#7)<FQ(#8)≈FQ(#9)≈FQ(PW) may hold.

Figure 3B:
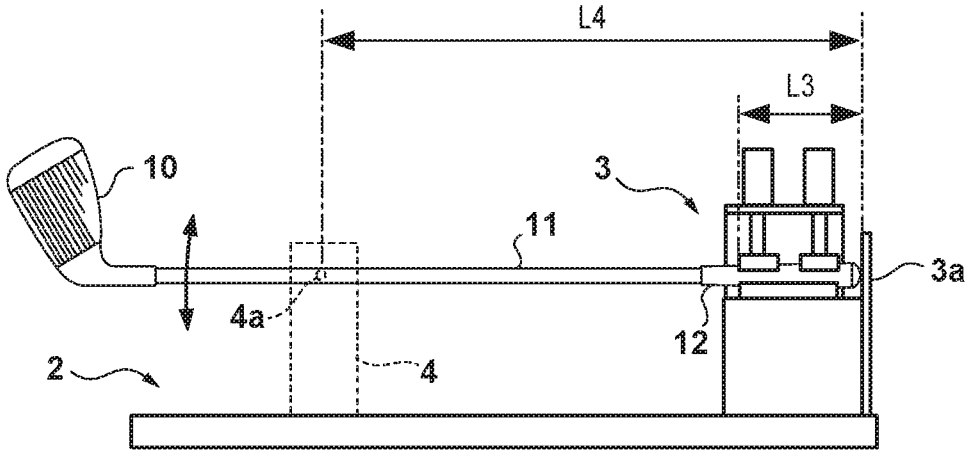
FIG. 3B is an explanatory view of a frequency measuring method.

A frequency measuring method will be described with reference to FIG. 3B. The frequency of a golf club can be measured by a measuring instrument. A measuring instrument 2 in FIG. 3B schematically shows an example. The measuring instrument 2 includes a fixing unit 3 that cantilever-supports a golf club at the grip 12, and a measuring unit 4 spaced apart from the fixing unit 3 in the shaft axis direction. The fixing unit 3 is provided with an abutting plate 3*a* against which the rearmost end of the grip 12 abuts. The measuring unit 4 includes a sensor 4*a*. The sensor 4*a* is, for example, a photointerrupter and detects the passage of the shaft 11. At the time of measurement, the head 10 is pulled and then released to vibrate the side of the head 10, and the sensor 4*a* measures the frequency per unit time. Note that the example of FIG. 3B shows a case in which the golf club is vibrated in the toe-heel direction of the head 10. To vibrate the golf club in the face-back direction of the head 10, the golf club is fixed in an orientation rotated by 90° about the axis of the shaft 11 from the direction in FIG. 3B (the face angle is 0° with respect to the horizontal plane) and vibrated.

Note that as for the frequency measuring conditions in this specification, if the position of the end of the grip 12 on the side of the head 10 fixed by the fixing unit 3 is set to a position apart from the rearmost end of the grip 12 by a distance L3, and the position of the measuring point is set to a position apart from the rearmost end of the grip 12 by a distance L4, the distance L3=197 mm, and the distance L4=770 mm. Even in an example to be described below, the frequency is calculated under these conditions.

EXAMPLE

Five golf club sets of different specifications were produced and evaluated by conducting test shot. FIGS. 4A to 4E show the specifications of the golf club sets. Each golf club set is an iron type golf club set and is formed by six golf clubs including a 5-iron (#5) to a pitching wedge (PW).

As the grips of the golf club sets, identical grips are used. The heads of the golf club sets are of the same model. The weights of some heads are adjusted to adjust the club balance. As the shafts of the golf club sets, shafts with different flexes or shafts for which shaft base tubes are prepared according to the club length in the same model are used in accordance with the specifications to be evaluated.

Specifications listed in FIGS. 4A to 4E include a lie angle θ1 (°), a loft angle θ2 (°), a shaft weight Ws (g), a shaft flex Fs (rigidity: R<S<X), a club length L1 (inches (1 inch=25.4 mm)), a total club weight Wc (g), a center-of-gravity position L2 (mm), a frequency FQ (cpm), and a club balance BL. θ1, θ2, L1, L2, and FQ correspond to θ1, θ2, L1, L2, and FQ described above with reference to FIGS. 2A to 3B. When measuring the frequency FQ, the head side was vibrated in the face-back direction. Usually, the frequency does not exhibit a significant difference even if the head side is vibrated in the toe-heel direction.

FIG. 4A shows the golf club set according to the example, and FIGS. 4B to 4E show the golf club sets according to Comparative Examples 1 to 4. FIG. 5 shows the minimum value and the maximum value of the frequency FQ of each golf club set and the difference between the maximum value and the minimum value.

The relationship of Comparative Examples 1 to 4 will be described. Comparative Example 1 is a golf club set having general specifications in which the club length changes between the clubs, and serves as the reference of evaluation. In Comparative Example 2, the loft angles were changed relative to the Comparative Example 1, and the lie angles and the club Lengths L1 were set to the same values. In Comparative Example 3, the shaft flex Fs was changed relative to the Comparative Example 2. In Comparative Example 1, the lie angles θ1, the loft angles θ2, and the club Lengths L1 were the same as in the example, and the same shaft flex Fs was set for all clubs, unlike the example. Details of each set will be described below.

The golf clubs of the golf club set according to the example shown in FIG. 4A have the same lie angle θ1, and the adjacent golf clubs have the same difference (4°) in the loft angle θ2. The shaft flex Fs is R for the 5-iron and the 6-iron, S for the 7-iron and the 8-iron, and X for the 9-iron and the pitching wedge. The smaller the loft angle is, the more flexible the club is. The larger the loft angle is, the more rigid the club is. Note that three shaft flexes Fs are used here. However, the number of shaft flexes Fs may be six according to the number of clubs, or may be two conversely. The shaft weight is 94 g to 103 g, and the difference is 9 g. The shaft weight difference is preferably 10 g or less. The total club weight Wc is 405 g to 431 g, and the difference is 26 g. The difference in the club length L1 between the adjacent golf clubs is 0.25 inches. The frequency FQ is 313 cpm for the 5 iron at minimum and 361 cpm for the pitching wedge at maximum. The difference is 48 cpm.

The golf club set according to Comparative Example 1 shown in FIG. 4B is different from the golf club set according to the example in the specifications of the lie angle θ1, the loft angle θ2, the shaft flex Fs, and the club length L1. The golf clubs of Comparative Example 1 do not have the same lie angle θ1, and the adjacent golf clubs have a difference of 0.5°. The adjacent golf clubs do not have the same difference in the loft angle θ2. The shaft flex Fs is S commonly for all clubs. The total club weight Wc is 403 g to 439 g, and the difference is 36 g. The difference in the club length L1 between the adjacent golf clubs is 0.5 inches. The frequency FQ is 322 cpm for the 5 iron at minimum and 357 cpm for the pitching wedge at maximum. The difference is 35 cpm.

The golf club set according to Comparative Example 2 shown in FIG. 4C is different from the golf club set according to the example in the specifications of the shaft flex Fs. The golf clubs of Comparative Example 2 have the same lie angle θ1, and the adjacent golf clubs have the same difference (4°) in the loft angle θ2. The shaft flex Fs is S commonly for all clubs. The total club weight Wc is almost the same for all clubs, and the difference is only 1 g. The club length L1 is common to all clubs. The frequency FQ is almost the same for all clubs, and the difference is only 1 cpm.

The golf club set according to Comparative Example 3 shown in FIG. 4D is different from the golf club set according to the example is the club length L1. The golf clubs of Comparative Example 3 have the same lie angle θ1, and the adjacent golf clubs have the same difference (4°) in the loft angle θ2. The specifications of the shaft flex Fs for the golf clubs are the same as in the example. The total club weight Wc is 411 g to 420 g, and the difference is 9 g. The club length L1 is common to all clubs. The frequency FQ is 320 cpm for the 5-iron at minimum and 351 cpm for the pitching wedge at maximum. The difference is 31 cpm.

The golf club set according to Comparative Example 4 shown in FIG. 4E is different from the golf club set according to the example in the specifications of the shaft flex Fs. The golf clubs of Comparative Example 4 have the same lie angle θ1, and the adjacent golf clubs have the same difference (4°) in the loft angle θ2. The shaft flex Fs is S commonly for all clubs. The total club weight Wc is almost the same for all clubs, and the difference is only 2 g. The difference in the club length L1 between the adjacent golf clubs is 0.25 inches. The frequency FQ is 324 cpm for the 5-iron at minimum and 352 cpm for the pitching wedge at maximum. The difference is 28 cpm.

In the test shot, a skilled player hits golf balls a plurality of times for each golf club, and the evaluations were organized as follows based on Comparative Example 1 as the reference.

In Comparative Example 2, concerning a club with a small loft angle θ2 such as the 5-iron, the player could not sense the deflection of the shaft and had difficulty in swing. The ball flight was low. As for a club with a large loft angle θ2 such as the pitching wedge, conversely, the shaft deflected too much, and shot control was not stable. In addition, since the club length L1 was common to all clubs, there was a strong sense of discomfort at address.

Comparative Examples 3 and 4 were better than Comparative Example 2. However, the deflection of the shaft still tended to be short in a club with a small loft angle θ2 such as the 5-iron, and conversely, the shaft tented to deflect too much in a club with a large loft angle θ2 such as the pitching wedge. In Comparative Example 3, since the club length L1 was common to all clubs, there was a strong sense of discomfort at address, in Comparative Example 4 however, there was not so strong sense of discomfort.

In the example, the deflection of the shaft was satisfactorily sensed as in Comparative Example 1 for all clubs. In addition, since the difference in the club length L1 between the clubs was smaller than in Comparative Example 1, the posture difference at address was small for all clubs, and the player could easily swing the clubs.

The relationship between the evaluations and the frequencies FQ will be examined with reference to FIG. 5. As is apparent, the frequency difference between the minimum value and the maximum value of the frequency FQ is larger in the example than in Comparative Examples 1 to 4. The frequency difference in Comparative Example 3 is 31 cpm, and the frequency difference in the example is 48 cpm. When the frequency difference is 40 cpm or more, the deflection of the shaft can satisfactorily be sensed in all clubs of the golf club set. That is, the golf club set is preferably designed such that the frequency difference between the club with the minimum loft angle and the club with the maximum loft angle becomes 40 cpm or more.

As for the minimum value of the frequency FQ, the minimum value in Comparative Examples 1 to 4 is 320 cpm in Comparative Example 3. In the example, the minimum value is 313 cpm. The golf club set is preferably designed such that the frequency of the club with the minimum loft angle becomes less than 320 cpm. As for the maximum value of the frequency FQ, the maximum value in Comparative Examples 1 to 4 is 357 cpm in Comparative Example 1. In the example, the maximum value is 361 cpm. The golf club set is preferably designed such that the frequency of the club with the maximum loft angle exceeds 360 cpm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2016-235252, filed Dec. 2, 2016, which is hereby incorporated by reference herein in its entirety.

What is claimed is:

1. A golf club set comprising a plurality of golf clubs having different loft angles, wherein the plurality of golf clubs have the same lie angle, each loft angle difference between two golf clubs that are adjacent in a loft angle order is the same, each club length difference between two golf clubs that are adjacent in the loft angle order is 0.125 inches (3.175 mm) (inclusive) to 0.375 inches (9.525 mm) (inclusive), a loft angle of a golf club having a minimum frequency is smaller than a loft angle of a golf club having a maximum frequency, the minimum frequency is less than 320 cpm, and the maximum frequency exceeds 360 cpm.

2. The golf club set according to claim 1, wherein each club length difference between two golf clubs that are adjacent in the loft angle order is 0.25 inches (6.35 mm)±0.079 inches (±2 mm).

3. The golf club set according to claim 1, wherein shaft flexes of the plurality of golf clubs are set such that the smaller the loft angle is, the more flexible the golf club is, and the larger the loft angle is, the more rigid the golf club is.

4. The golf club set according to claim 1, wherein a difference between a maximum shaft weight and a minimum shaft weight is not more than 10 g.

5. The golf club set according to claim 1, wherein the golf club set includes at least:

a golf club having a minimum loft angle;

a golf club having a maximum loft angle; and a golf club having an intermediate loft angle between the minimum loft angle and the maximum loft angle, a frequency of the golf club having the minimum loft angle is lower than a frequency of the golf club having the intermediate loft angle, and a frequency of the golf club having the intermediate loft angle is lower than a frequency of the golf club having the maximum loft angle.

6. The golf club set according to claim 1, wherein the plurality of golf clubs comprise golf clubs including a 5-iron to a pitching wedge.

7. A golf club set comprising a plurality of golf clubs having different loft angles, wherein the plurality of golf clubs have the same lie angle, each loft angle difference between two golf clubs that are adjacent in a loft angle order is the same, each club length difference between two golf clubs that are adjacent in the loft angle order is 0.125 inches (3.175 mm) (inclusive) to 0.375 inches (9.525 mm) (inclusive), a loft angle of a golf club having a minimum frequency is smaller than a loft angle of a golf club having a maximum frequency, a difference between the minimum frequency and the maximum frequency is not less than 40 cpm, and each club length difference between two golf clubs that are adjacent in the loft angle order is 0.25 inches (6.35 mm)±0.079 inches (±2 mm).

8. The golf club set according to claim 7, wherein shaft flexes of the plurality of golf clubs are set such that the smaller the loft angle is, the more flexible the golf club is, and the larger the loft angle is, the more rigid the golf club is.

9. The golf club set according to claim 7, wherein the golf club set includes at least:

a golf club having a minimum loft angle;

a golf club having a maximum loft angle; and a golf club having an intermediate loft angle between the minimum loft angle and the maximum loft angle, a frequency of the golf club having the minimum loft angle is lower than a frequency of the golf club having the intermediate loft angle, and a frequency of the golf club having the intermediate loft angle is lower than a frequency of the golf club having the maximum loft angle.

10. The golf club set according to claim 7, wherein the plurality of golf clubs comprise golf clubs including a 5-iron to a pitching wedge.

11. A golf club set comprising a plurality of golf clubs having different loft angles, wherein the plurality of golf clubs have the same lie angle, each loft angle difference between two golf clubs that are adjacent in a loft angle order is the same, each club length difference between two golf clubs that are adjacent in the loft angle order is 0.125 inches (3.175 mm) (inclusive) to 0.375 inches (9.525 mm) (inclusive), a loft angle of a golf club having a minimum frequency is smaller than a loft angle of a golf club having a maximum frequency, a difference between the minimum frequency and the maximum frequency is not less than 40 cpm, and a difference between a maximum shaft weight and a minimum shaft weight is not more than 10 g.

12. The golf club set according to claim 11, wherein shaft flexes of the plurality of golf clubs are set such that the smaller the loft angle is, the more flexible the golf club is, and the larger the loft angle is, the more rigid the golf club is.

13. The golf club set according to claim 11, wherein the golf club set includes at least:

a golf club having a minimum loft angle;

a golf club having a maximum loft angle; and a golf club having an intermediate loft angle between the minimum loft angle and the maximum loft angle, a frequency of the golf club having the minimum loft angle is lower than a frequency of the golf club having the intermediate loft angle, and a frequency of the golf club having the intermediate loft angle is lower than a frequency of the golf club having the maximum loft angle.

14. The golf club set according to claim 11, wherein the plurality of golf clubs comprise golf clubs including a 5-iron to a pitching wedge.

* * * * *